US005867964A

United States Patent [19]

Perrin

[11] Patent Number: 5,867,964

[45] Date of Patent: Feb. 9, 1999

[54] PREFABRICATED CONSTRUCTION PANELS AND MODULES FOR MULTISTORY BUILDINGS AND METHOD FOR THEIR USE

[76] Inventor: Arthur Perrin, 13000 SW. 120 St., Miami, Fla. 33186

[21] Appl. No.: 767,849

[22] Filed: Dec. 17, 1996

Related U.S. Application Data

[63] Continuation-in-part of Ser. No. 575,343, Dec. 20, 1995.

[51] Int. Cl.[6] ..... E04B 1/00

[52] U.S. Cl. ..... 52/745.1; 52/236.8; 52/236.9; 52/251; 52/745.08

[58] Field of Search ..... 52/236.7, 236.8, 52/236.9, 251, 481.1, 745.05, 745.08, 745.1, 259, 439, 745.06, 745.09; 264/31, 35

[56] References Cited

U.S. PATENT DOCUMENTS

| | | | |
|---|---|---|---|
| 1,219,272 | 3/1917 | Edison . | |
| 2,035,697 | 3/1936 | Felber | 52/206 X |
| 2,076,728 | 4/1937 | Keller | 52/210 |
| 2,076,877 | 4/1937 | Brown | 52/210 X |
| 3,149,437 | 9/1964 | Wheeler . | |
| 3,374,592 | 3/1968 | Cheskin . | |
| 3,678,638 | 7/1972 | Mougin . | |
| 3,683,577 | 8/1972 | Spillman . | |
| 3,698,147 | 10/1972 | Sikes . | |
| 3,751,864 | 8/1973 | Berger et al. . | |
| 4,078,344 | 3/1978 | van de Lely . | |
| 4,078,345 | 3/1978 | Piazzalunga . | |
| 4,107,886 | 8/1978 | Ray et al. . | |
| 4,136,495 | 1/1979 | Frederick . | |
| 4,211,045 | 7/1980 | Koizumi et al. . | |
| 4,235,054 | 11/1980 | Cable et al. | 52/481.1 X |
| 4,338,759 | 7/1982 | Swerdlow et al. . | |
| 4,398,378 | 8/1983 | Heitzman . | |
| 4,409,764 | 10/1983 | Wilnau . | |
| 4,516,372 | 5/1985 | Grutsch . | |
| 4,525,975 | 7/1985 | McWethy . | |
| 4,597,813 | 7/1986 | Hipkins | 52/210 X |
| 4,625,484 | 12/1986 | Oboler . | |
| 4,660,331 | 4/1987 | Dahlen et al. . | |
| 5,048,257 | 9/1991 | Luedtke . | |
| 5,371,990 | 12/1994 | Salah Uddin . | |
| 5,479,749 | 1/1996 | Colasanto et al. | 52/236.9 |
| 5,657,606 | 8/1997 | Ressel et al. | 52/481.1 X |
| 5,737,895 | 4/1998 | Perrin | 52/745.1 |

*Primary Examiner*—Christopher Kent
*Assistant Examiner*—Timothy B. Kang
*Attorney, Agent, or Firm*—Robert M. Schwartz; Gerald R. Hibnick

[57] ABSTRACT

A monolithic, reinforced concrete framework for a multi-level, multi-unit building results from the utilization of factory prefabricated and finished wall panels, floor/ceiling panels and utility core modules, the juxtaposition of which, without forms, defines volumetric beam voids. The beam voids are exterior to the wall panels, floor/ceiling panels and core modules. Wall panels include light gage studs, which are loadbearing studs, and light gage column frames. Beam voids and column frames for a building level are poured with concrete at one time. Each building level is erected and poured in one day; and the next level can commence the following morning, without need for exterior scaffolds. The beams and columns carry the weight of the building down into the foundation. Large open areas, such as lobbies, can be provided, using building weight supporting trussed wall panels having support for the beams overlying the open area.

13 Claims, 6 Drawing Sheets

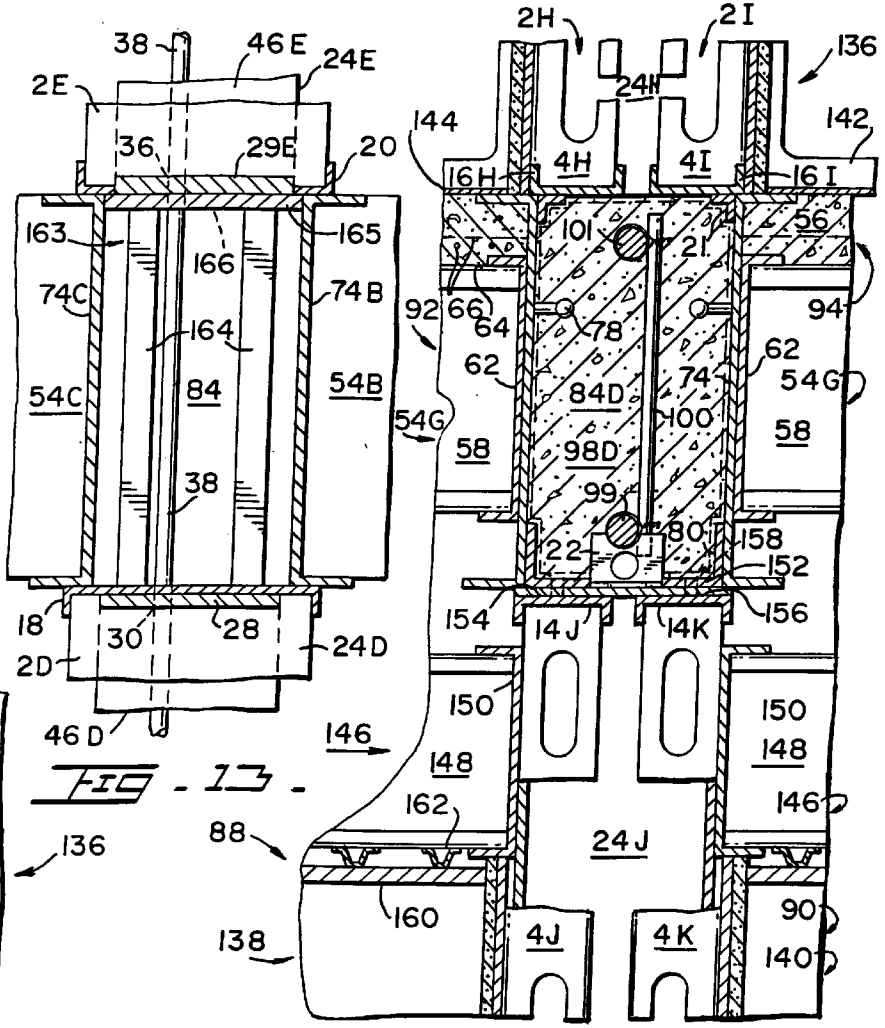
FIG. 12
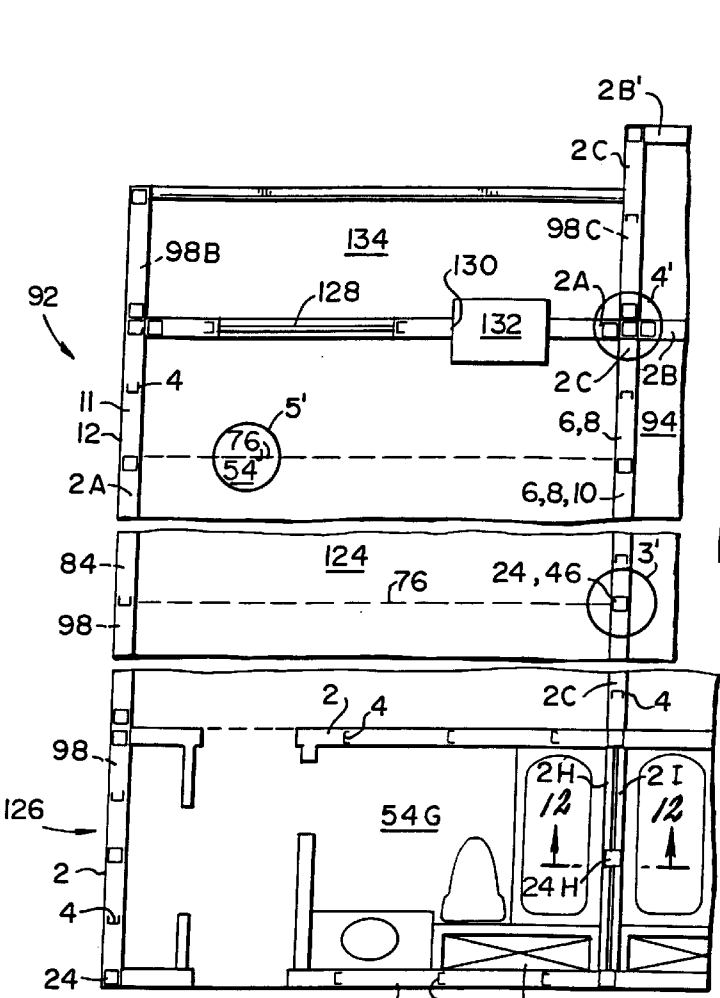
FIG. 13
FIG. 11

PREFABRICATED CONSTRUCTION PANELS AND MODULES FOR MULTISTORY BUILDINGS AND METHOD FOR THEIR USE

This is a Continuation-In-Part of U.S. Pat. application Ser. No. 08/575,343, filed Dec. 20, 1995.

BACKGROUND OF THE INVENTION

I. Field of the Invention

This invention relates to the construction of multistory buildings employing prefabricated panels and modules, and more particularly with a method of construction in which, after the panels and modules are erected on the job site, concrete is poured to create a structural framework of beams and columns.

II. Description of the Related Art

Multistory, noncombustible, building construction typically is of one of five basic structural types or combinations thereof: reinforced concrete frame, reinforced wall bearing masonry, structural steel framework, precast concrete framework, or light gage steel bearing wall. Each of these methods of construction is subject to cost disadvantages due to one or more of: time, labor, materials, weight, and complexity of assembly. Reinforced concrete frame construction requires the on site labor and time to build forms for the wet concrete, waiting for it to harden, and then time and labor to remove the used forms. Thereupon, the building is completed and finished on site with expensive job site labor and materials. Reinforced wall bearing masonry uses concrete block walls held together with mortar, then reinforced with steel rods and filled with concrete to produce the bearing walls. This is reasonably economic in materials and time, but is limited to a few stories high and then must be completed with job site materials and labor, at prime cost. Structural steel or precast concrete framework construction is commonly used in highrise work, but require the heavy steel or concrete supporting frame structure; the ceilings, walls and all the interiors to be completed and finished with on site labor and materials, a costly construction.

Light gage steel bearing wall construction employs framing partitions of light gage steel members assembled into panels. These members are load bearing and can be assembled into panels at the job site, prior to erection, but can be assembled more economically in a controlled factory environment. However, the remainder of the building then is completed and finished with costly job site labor and materials.

To some extent, the just discussed methods of multistory building can benefit economically from the use of a combination of prefabricated wall panels and modules, the modules often including bathrooms and kitchens. Such panels and modules are not load bearing and are put in place after the load bearing columns and beams of concrete or steel are built and the floors laid.

An early patent for reinforced concrete construction issued to Thomas Edison in 1917, U.S. Pat. No. 1,219,272. Frederick 4,136,495; Koizumi, et.al. 4,211,045; Wilnau 4,409,764 and Luedtke 5,048,257 combine the advantages of reinforced concrete and steel framework by using portions of the steel framework as non-removable forms for the poured concrete columns and beams.

Oboler 4,625,484 employs non-load bearing, light weight floor and wall panels, along with I-beams, etc., to enable concrete to be poured around the panels to form a concrete shell.

Grutsch 4,516,372 uses foam plastic wall panels, positioned spaced apart for concrete to be poured therebetween to form reinforced concrete walls.

Sikes 3,698,147 assembles on site hollow metal columns, each having several parts; then erects the columns on the foundation. Outer and inner wall panels are attached to the columns; lastly, the columns are filled with concrete. The inner and outer wall panels can be fabricated off site and then on site be connected to the erected columns, prior to pouring the concrete.

Spillman 3,683,577 casts in place concrete columns and beams, using wall panels as physical shuttering forms, but the wall panels have no actual contact with the concrete.

Piazzalunga 4,078,345 prefabricates entire room units, including kitchens and bathrooms; the walls, ceiling and floor are of reinforced concrete. The entire room unit is dropped into place on a foundation having imbedded vertical steel beams, which are covered with concrete and define the perimeter of each room. The room units then are coupled to the vertical beams.

Berger 3,751,864 teaches the prefabrication of modular units, each of which can encompass one or more rooms, and includes pre-installation of electrical and plumbing needs. The walls surrounding each unit and its ceiling are of corrugated steel. During erection of the building, the modules are positioned next to each other, with spaces therebetween, and vertical form boards are inserted into those spaces to complete, with adjacent corrugations, vertical forms for columns, to be filled with poured concrete. Similarly, horizontal form boards are secured below the tops of the corrugated walls of two adjacently spaced modules and define therewith a horizontal form, which is filled with concrete to make a ceiling beam.

McWethy 4,525,975 prefabricates modules, such as hotel rooms, each having a reinforced concrete floor, nonload-bearing walls, plumbing and electrical lines. The modules of one level are placed adjacent to each other, with vertical space between their walls. These adjacent walls then are latched to each other for maintaining the vertical space. Thereupon, concrete is poured into the vertical space to make an entire concrete wall surrounding these sides of the module. After the concrete is hardened to become load bearing, the next level of modules is put in place, with the reinforced concrete floor becoming the ceiling of the lower level module.

Swerdlow 4,338,759 prefabricates wall panels, each having a plurality of load bearing steel studs and a plurality of vertical tubes disposed on sixteen inch centers. In the top of each wall module is a U-shaped channel which is in fluid communication with the open tops of the vertical tubes. After the panels for one or more rooms are set up on a single floor level and are interconnected, a precast concrete ceiling is placed on top of the panels. The studs in the panels support the compression load of the ceiling. Thereupon, in a single pour, the channels and tubes are filled with concrete, and become load bearing columns and beams, respectively, all lying within the wall panels.

Mouglin 3,678,638 fabricates room modules off site and then trucks them to the job site. Hence, the room modules are limited to tractor trailer width of ten to twelve feet. The wall and ceiling panels of a room module include a complex arrangement of steel U and L-channels, which are welded together to create a reinforcing framework for each panel and to define portions of open faced forms, T-shaped for beams and rectangular for columns. At the job site, room modules for one level are positioned next to, but slightly spaced from each other, with the open channels facing each other to complete most of the form portions. The spaces between modules then are bridged by additional form members; after which the concrete is poured, to fill the beam and column forms. After the concrete is sufficiently hardened to be stress loadbearing, the next level of room modules are set into place.

The above presented prior art, which is a minute sampling of the vast amount of art, clearly shows a recognition of the advantages of prefabricated, preferably factory produced under controlled environment, wall panels, room units and modules. Unfortunately, the specific prior art solutions have been, to a great extent, impractical and therefor not utilized. For example, the prior art teachings require one or more of: units and modules too large and/or too heavy to be transported from factory to building site; too many different component parts needed to be in factory inventory and then be design-selected at the factory and job site for a specific part of a building, such design-selection being by experienced and costly labor; the use of unique forms within the panels and modules for receiving concrete for making therein columns and beams; the need for on site pouring of large quantities of concrete to form complete shells around the prefabricated room units, thus resulting in great compression force to the walls and supports on the lower levels, as well as long hardening and curing times.

SUMMARY OF THE INVENTION

The present invention overcomes many of the problems left unrecognized or unresolved by prior art prefabrication of wall panels, floor and ceiling panels and core modules, especially including utility core modules for use in multistory buildings and methods of erecting such buildings. One of the features of the invention is the economical factory fabrication of the more complex core or utility core portions of a building, such as kitchens and bathrooms, into a totally completed and loadbearing module; and transporting and installing this module as a completed unit. Likewise, it is a feature of this invention to panelize empty spaces, such as living, dining and sleeping areas of apartments and motel rooms; which can be fabricated, transported and erected more economically.

The wall panels, exterior and interior, are prefabricated under controlled environment, factory conditions employing, for the most part, conventional construction materials and panel configurations. The panel wall boards are affixed to vertical, light weight steel studs which have sufficient compression load bearing to support at least one upper level of room unit wall panels and modules and floor/ceiling prefabricated panel units, the latter including thin topping concrete. The wall panels of this invention are factory fabricated with: insulation, electrical fixtures and wiring, installed exterior doors and windows, interior door openings, finishes, etc., and are so universally adaptable that only a few variations are needed for an entire building, for example a multistory motel. Within most of the prefabricated wall panels is one, or at most a few, hollow, light weight steel column frames, themselves not load bearing.

Combined floor/ceiling panels of this invention also are prefabricated at the factory, including a preferred thin concrete topping floor portion. Except for carpeting and paint, these floor/ceiling panels are finished totally. They are designed to be laid on top of the edges of the wall panels, prior to any pouring of concrete.

Core modules are totally built and finished at the factory, including: all module wall panels, plumbing, mechanical and electrical features, fixtures, wiring and piping, cabinets, tubs, sinks, ceramic tile, vinyl tile, paint, etc.

The height, width, depth and weight of the wall panels, floor/ceiling panels and core modules are designed to fit onto standard eight foot wide flatbed tractor trailers and be erected with a conventional truck crane. Thus, at least eighty-five per cent of the multi-story building can use factory production and not expensive on site construction time and labor. The foundation is poured on site and can be a standard concrete spread footing with concrete stem walls.

The positioning of floor panels on the stem walls and the one level at a time erecting and positioning of the wall panels and modules relative to the floor/ceiling panels define therebetween horizontal voids, which will become the beams, when filled with concrete. These voids/beams do not lie inside any of the vertical or horizontal panels or modules. These voids can be provided with reinforcing bars just prior to concrete pouring. The floor/ceiling panels are provided with anchors which project into the voids. The top and bottom of the hollow steel column frames in the wall panels open into the beam forming voids. Thus, a single pouring of concrete, for a specific level of the building, without need of removable forms, will fill all the beam voids and hollow steel column frames for that level to create the load bearing column and beam structural framework and, most importantly, tie all of the vertical and horizontal panels together as if a monolithic structure. Moreover, the prefabrication of the exterior wall panels includes all exterior finishing; hence, the method of construction of a multilevel building without use of removable forms enables such construction to avoid need for external scaffolds or temporary bracing.

To enable a lobby or other large open areas to be constructed and not require therein columns, walls or other load supporting elements, but otherwise using this invention's unique panels and its unique, monolithic concrete beam-column system and efficient concrete pouring method, each of the wall panels on the one level above and overlying the desired large open area is prefabricated to include a truss member, thus causing those wall panels to become trussed wall panels for supporting the building load thereabove. The concrete beams, directly above the large open area and directly below the trussed wall panels, cannot support themselves over the long spans of the large open area. Beam support is provided by utilizing the vertical reinforcing bars, which normally pass through the concrete columns in the wall panels into the beams. Those reinforcing bars are shaped and positioned to hook under the horizontal reinforcing bars in the beams.

The above mentioned construction components and method of construction and their benefits will become understood better in light of the following description of preferred embodiments of the invention.

BRIEF DESCRIPTION OF THE DRAWINGS

In the drawings that form part of the description of the present invention,

FIG. 11 is a top, sectional view of a typical motel room;

FIG. 12 is a vertical section, similar to FIG. 9, through two levels of back-to-back utility core modules, taken along the line 12—12 of FIG. 11;

FIG. 13 is a vertical section of the beam void, similar to FIG. 9, for showing a bearing compression fitting;

DETAILED DESCRIPTION OF THE INVENTION

Figure 1:
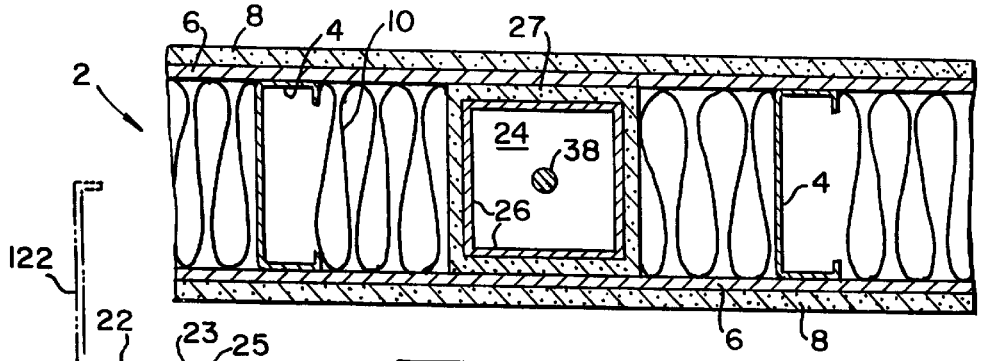
FIG. 1 is a top view, in section, of a portion of a wall panel.
Figure 2:
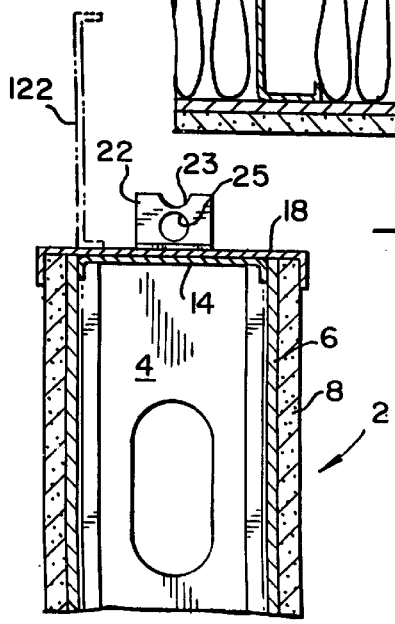
FIG. 2 is an end view, in section, of a wall panel.
Figure 3:
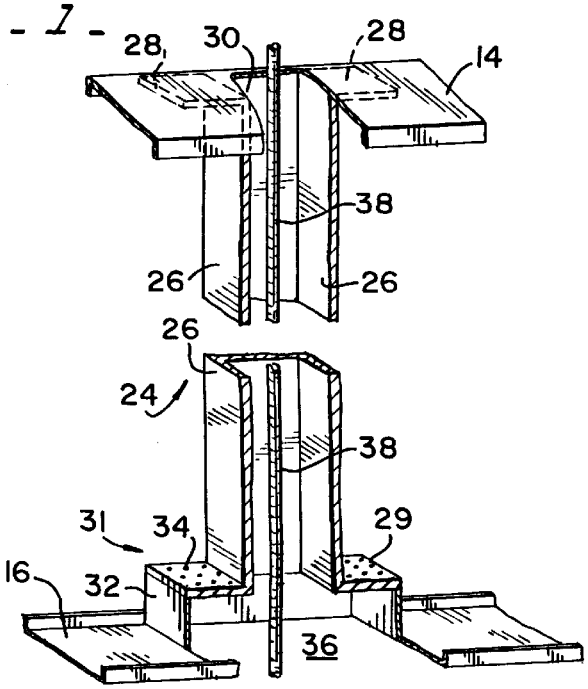
FIG. 3 is a perspective, front view, mostly in section, of the steel frame for a bearing column.
Figure 4:
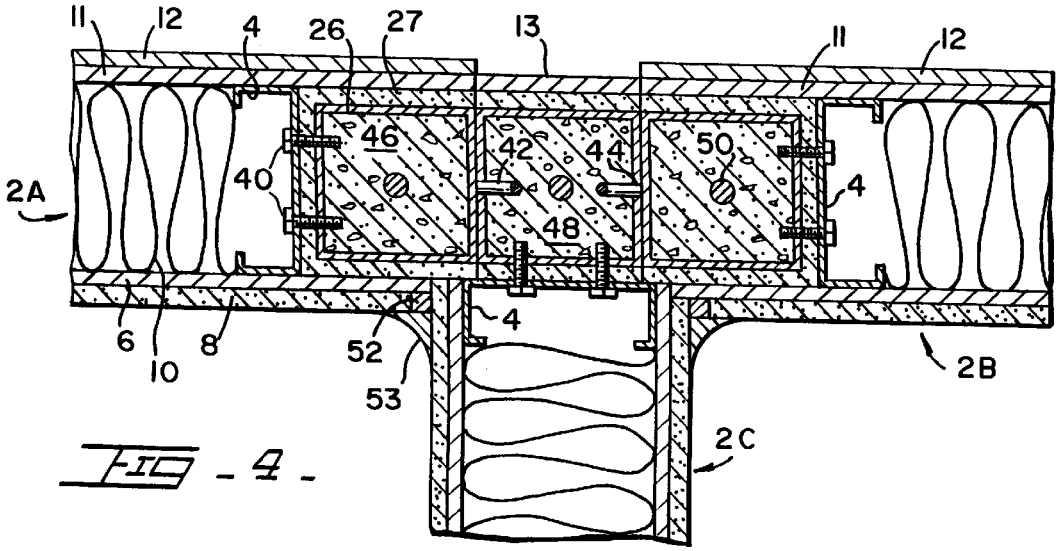
FIG. 4 is a top view, in section, of two exterior wall panels connected to an interior wall panel; each wall panel including a concrete filled column frame.

One of the basic building blocks, prefabricated in a controlled factory environment for use in this invention, is the loadbearing wall panel 2; a preferred embodiment of which is shown first in FIGS. 1, 2 and 4. "Loadbearing", as used herein with respect to the wall panel 2, means that this wall panel 2 is capable of temporarily supporting the compression weight of two levels of floor/ceiling panels (to be described further below), plus the weight of one level of wall panels and the weight of two beam voids filled with wet concrete, without the need for any beams or loadbearing concrete columns. "Loadbearing", with respect to the panel 2, additionally means that the panel 2 can support the compression weight of wet concrete poured along the top of the panel 2, in forming beams of approximately six by twelve inch cross-section, until the concrete in the beam voids and column frames (shown in FIG. 3) harden and assume the responsibility of taking all the weight of the building through the structural beam and column framework down into the foundation. An alternative construction of the wall panel 2 can be totally loadbearing, without the need of concrete columns, for lowrise buildings; and can be used with a relatively few columns for higher buildings. The loadbearing capability of the preferred embodiment of the wall panel 2 can be provided by standard six inch, light gage metal studs 4, of about twenty gage steel, placed vertically in the panel on about sixteen to twenty-four inch centers. These studs 4 and all of the component materials and all but two of the component parts used according to this invention are standard for the building construction industry. Accordingly, utilizing this invention will meet building codes, without special permits.

The interior wall portions of the wall panel 2 can comprise a layer 6 of sound deadening or insulation, board, over which would be wallboard 8, for example ⅝ inch type-X fire rated gypsum board. These wall boards 6 and 8 are secured to the studs 4 by conventional means not shown. Desirably, fiberglass insulation 10 up to six inches thick, fills most of the interior of the wall panel. If the wall panel 2 is an interior panel, as shown in FIG. 1, then both sides would be covered with the wall boards 6 and 8. If the wall panel 2 is an exterior wall, as shown in FIG. 4, the prefabrication at the factory also will include an exterior sheathing board 11, in lieu of the sound deadening board 6, and the complete exterior finishing surface materials 12. Surface materials, such as stucco, aluminum siding, vinyl siding, decorative features, reveals 13, etc. all are made part of the exterior of the wall panel 2 at the factory.

The height of a wall panel would be the height of the room, for example eight feet. The length of wall panels would depend upon the room(s) length and width. Typical apartment and motel configurations utilize walls of fourteen to twenty-eight feet in length; such length can be achieved according to the present invention with a single wall panel 2. Although loadbearing wall panels 2 having dimensions exceeding eight by twenty-eight feet would not pose factory prefabrication or on site erection problems, especially since these panels are relatively light weight, the factory to job site transportation could affect the panel size. The bed of tractor trailers are of various standard sizes to meet intercity, intracity, interstate and intrastate licensing. Also, in some cities or portions thereof, the streets might not be wide enough to accommodate extra wide or even wide load or long bed trucks. Once the job site is known and the transportation consideration logistics resolved, the architect and prefabrication management can decide upon the best selection of panel lengths, one important additional criteria being employing the fewest panel configurations, so as to maximize the factory prefabrication efficiencies. For large building projects, the "factory" could be a warehouse or merely a covered area adjacent to the job site, to limit and simplify the transportation logistics.

As shown in FIG. 2, an end view of the wall panel 2, the top and bottom of each of the loadbearing studs 4 are fit into basic metal tracks 14 and 16, respectively, which run the length of the panel. Similarly, the entire panel is secured, if required for strength, at its top and bottom, by an optional pair of metal tracks 18 and 20, respectively. These two sets of tracks 14 and 18, and 16 and 20 can be of sixteen gage and joined by spot welds or screws, not shown. The inner tracks 14 and 16 also are secured to the studs 4 by spot welds or screws through the legs of the tracks. L-shaped guides 21 are secured to the bottom of the panel by spot welds or screws to the optional track 20, or to the basic track 16 if the optional track 20 is not needed for rigidity. These guides 21 can be ¾ by ¾ inch and are spaced along the length of the panel to assist in the positioning of the panels by the crane, as will be detailed hereinafter. An important function of the optional outer top and bottom tracks 18 and 20 is to protect the face of the top and bottom of the wall board 8 from damage, especially during transport of the finished panels to the job site and erection thereat. The cost and weight of the tracks 18 and 20 can be eliminated if reasonable care is given to the finished panel 2 during transport and job site erection. Any small damage to the bottom of the wallboard 8 can be covered over by baseboard type members, often plastic, which would be installed at the time just after the erected wallboard is painted on site. The optional top and bottom tracks 18 and 20, or the basic tracks 14 and 16 if tracks 18 and/or 20 are eliminated, also are employed to define the lower and upper limits of a volumetric void that is required for the beams, as will be described in detail hereinbelow.

A plurality of L-shaped clips 22 (only one of which can be seen in FIG. 2) are secured to the center of the top of optional track 18, or the basic track 14 if the optional track 18 is omitted. The clips 22 can be sixteen gage steel, two inches wide, of two by two inch stock, having a curved or notched top edge 23 and a large bore 25 through the upstanding leg. These clips 22 would be spaced about three feet apart, along the top of the panel 2. The function of clips will be discussed hereinafter.

FIG. 3 shows the frame 24 for one of the columns, which will become the primary loadbearing vertical supports for the entire building, once the column frame 24 is filled with concrete and the concrete has hardened. The frame 24 is factory fabricated and installed into the wall panel 2 at the factory. A convenient shape for the main vertical body of the frame 24 is rectangular or square; five inches on a side 26 and of light weight steel, such as eleven gage, or as small as three inches square of 3/16 inch steel. As seen in FIG. 1, the sides 26 of the column frame 24 can be surrounded with gypsum wallboard 27, for example ½ inch type-X, to provide added fire protection. The top and bottom of the frame 24 include two pairs of flanges 28 and 29, seen in FIG. 3, which are welded to the sides 26 and fit between the wallboards 6 and 8. The flanges 28 fit just beneath and in bearing contact with the metal track 14 and the optional track 18 (track 18 is not shown in FIG. 3). The flanges 28 and 29 have the function of transferring to the column the load of the beam, (not shown in FIGS. 1–4), which will lie along the top of the wall panel 2. The tracks 14 and 18 have large openings 30 positioned over and the same size as the open top of the frame 24, so that concrete can be poured from above the tracks 18 and 14 and flow into the column frame, down and into contact with the previously poured beam of the lower level. The sides 26 and the bottom flanges 29 of the column frame 24 can extend into contact with the inner bottom track 16.

Preferably, the lower end of the column frame 24 includes a bearing box 31 which encircles the frame and its flanges 29. The bearing box 31 has side walls 32, the top edges of which are attached to the bottom flanges 29 by welding or soldering. The side walls 32 seat on top of the bottom track 16. The bottom flanges 29 can be perforated, as at 34, to permit air to escape from the bearing box 31 as it is being filled with concrete. The bearing box 31 is open at its bottom, which lies over a large opening 36 in the track 16. Thus, the concrete bottom surface of the bearing box will be in surface contact with a concrete beam, which lies directly below the wall panel 2. The bearing box 31 can be four inches high and be of sixteen gage steel. The bearing box is attached to the bottom flanges 29 prior to the column frame 24 being inserted into the wall panel 2. The reinforcing bar 38 shown in FIG. 4 is installed at the job site, prior to pumping of the concrete. An alternative embodiment for the bearing box 31 is to tightly fit its flanges 29 flush with the bottom of the bottom track 16 and inside the large opening 36. A recessed pocket (not illustrated), having a volume similar to that of the bearing box, is to be made in the beam, just below the column frame 24 and flanges 29, to receive concrete as it is being poured to fill the column frame 24. The recessed pocket could be made by scooping out some of the previously poured beam, while its concrete was only partially hardened. In lieu of the bearing box 31, the column frame sides can be extended with a compression absorbing cushion (not shown), for example an elastomeric bearing pad, which would be positioned between the bottom of the flanges 29 and the top side of the inner track 16.

An alternative to the bearing box 31 is described with reference to FIG. 13 and involves the beam void and beam discussed with reference to FIGS. 9 through 12.

FIG. 4 shows, in top section, the T-shaped junction of two exterior loadbearing wall panels, 2A and 2B, with an interior loadbearing wall panel 2C. Such a junction would be typical in a motel, with the interior wall panel 2C being the common wall between two adjacent motel suites. In an apartment building floor plan, the wall panel 2C could separate one apartment from another, or be a loadbearing wall lying between two rooms, such as a living room and a master bedroom. Near the ends of each of these wall panels is a loadbearing steel stud 4, through which project fasteners 40, such as self-drilling cap screws, such as 1 ½ inches by ¼ inch, which secure a sidewall 26 of the column frame 24 to a stud 4. Since the column frames 24 in FIG. 4 are positioned at the ends of their respective panels 2A, 2B and 2C, such frames are identified hereinafter as end column frames 24, in contrast to the column frame 24, in FIG. 1, which is positioned remote from the ends of the panel 2 and therefore called interior column frames. Because of their end orientations, the end column frames 24 do not require/possess portions of the flanges 28 and 29 and the bearing box 31 which are external to the farthest side 26 of the respective end column frame 24. The securing of the end column frames to the studs is part of the factory prefabrication. Installing all of the column frames 26 into the wall panels 2 as part of the prefabrication process precisely locates the columns, simplifies the erection procedure and reduces time and additional on site labor costs.

Also included in the prefabrication is the welded placement of conventional steel stud anchors 42, or slightly bent rods or bolts, to project outwardly from at least one side 26 of the end column frame 24. Aligned with the stud anchors are perforations or small slots 44 in the side walls 26. During job site erection and alignment of the various wall panels, the stud anchors 42 of one end column frame will project through an aligned perforation 44 in the side of an adjacent, abutting end column frame in another wall panel, as shown in FIG. 4, for ensuring proper positioning of the wall panels 2A, 2B, and 2C relative to one another, without need for exterior scaffolds, or temporary interior bracing, etc. After the concrete 46 is poured and hardened in the end column frames 24, the stud anchors are imbedded and held fast in the concrete portion of the column, immobilizing that column with respect to the adjacent column frame to which that stud anchor was originally secured. For example, the anchors 42 projecting from the wall panels 2A and 2B are inserted through slots 44 and imbedded in the concrete column 48 in the wall panel 2C. The column frames can be provided with standard reinforcing bars 50. Fire sealing caulk 52 and/or molding 53 can be provided to close any gap that might exist at the interior corners of abutting wall boards 8.

The vertical reinforcing bars 50, placed just prior to pouring the concrete at each level, are extended vertically within its respective column frame 24, from floor to floor, through the entire height of the building structure, from the foundation to the roof. These bars 50 are slightly longer than the length of one floor level height and are spliced and lapped a minimum of 30 bar diameters, to create a continuous structural member to resist all vertical forces placed upon the building, including uplift. Accordingly, the column frames 24, fitted with a continuous series of reinforcing bars 50 and filled with concrete 46, become a column 48 and have the ability to absorb and distribute the vertical building loads to the foundation. Since the columns absorb and distribute the vertical loads, the bearing wall panels 2, both interior 2C and exterior 2A and 2B, must resist and distribute the horizontal wind or shear forces acting on the building. One way of designing the wall panel 2 to resist shear forces is to install a series of internal "X" steel bracing strapping to both sides of the steel stud/track framework, prior to covering the wall panel with any board finishes. Such steel bracing strapping (not shown in FIGS. 1–4 for clarity) would be designed and screwed or welded in place to the steel panel framework in accordance with the structural design requirements; i.e., the various wall panels 2 for a ten story high building would require much more "X" bracing to resist wind shear forces than a four story high building.

An alternative construction of the wall panel 2 permits a more economical building, especially for lowrise buildings, since it eliminates the need for concrete columns 48 and their associated column frames 24. By increasing the strength of the loadbearing studs 4, so that they directly and permanently support the concrete beams and building loads above, the concrete columns would not be needed. By using studs 4 of sixteen or eighteen gage and, if necessary, securing them back-to-back (as shown with respect to the floor joists in FIG. 7), the studs will possess sufficient strength to carry the building loads down to the foundation for lowrise buildings. For taller buildings, some few concrete columns are recommended, so that their internal, continuous, spliced reinforcing bars 38 are present to resist any building uplift forces. Those concrete beams with or without the columns would continue to have the primary task of bonding all the walls, ceilings and floors into one monolithic structural framework. Because of the resulting monolithic framework, some architects might recommend the presence of a few of the concrete columns 48 even in lowrise buildings.

Moreover, since the topmost few floor levels of a taller building are, with respect to load, like a lowrise building, they can benefit from the more economic wall panels, lacking concrete columns, or at most having a very few columns.

Figure 5:
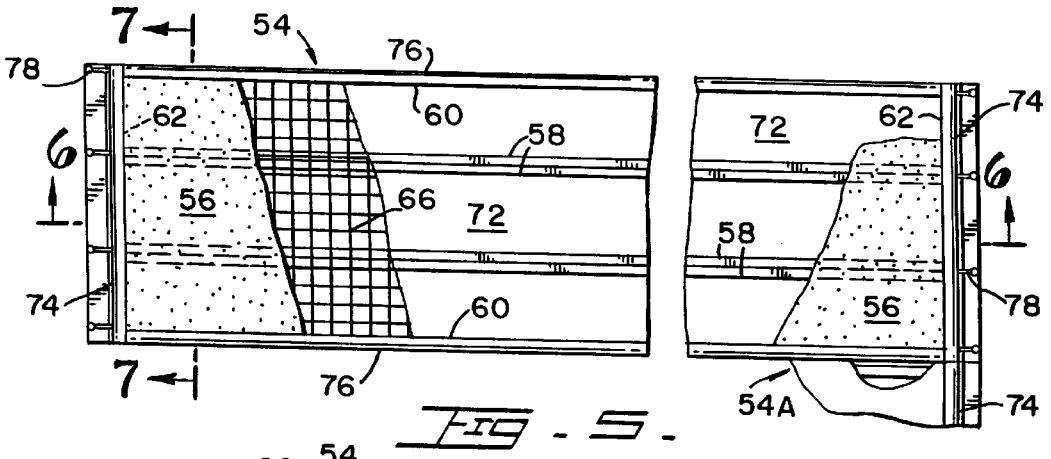
FIG. 5 is a top, plan view of a floor/ceiling panel.
Figure 6:
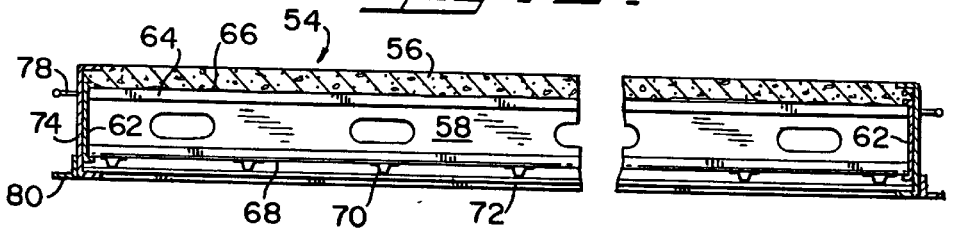
FIG. 6 is a longitudinal section of the floor/ceiling panel, taken along the line 6—6 of FIG. 5.
Figure 7:
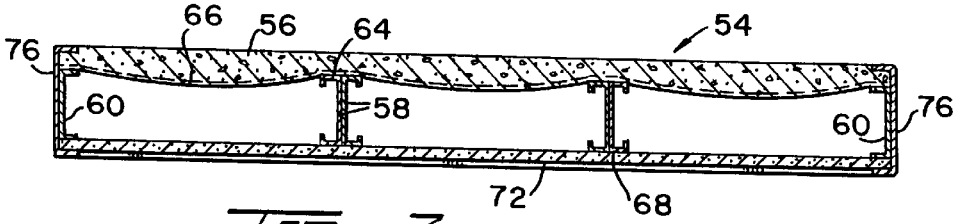
FIG. 7 is a lateral section of the floor/ceiling panel, taken along the line 7—7 of FIG. 5.

A typical floor/ceiling panel 54 is shown in FIGS. 5 through 8, including a preferred embodiment, which includes a thin concrete topping 56 for the floor. The floor/ceiling panel 54 is constructed and finished entirely at the factory, except for: carpeting, base molding, a ceiling cornice which would finish the horizontal edge where the ceiling meets a wall panel, ceiling trim where adjacent ceiling panels abut, and paint or acoustic spray for the ceiling. The structure and many of the components of the floor/ceiling panel 54 are similar to those of the wall panel 2. For example, light gage, C-shaped, eight inch deep, eighteen gage steel joists 58 and 60 run the lengths of the floor, such length becoming the width of a room unit of the completed building. The joists 58 are interior and the joists 60 are at the sides of the panel 54. The length of a floor/ceiling panel 54 might typically be sixteen feet, but could be as long as twenty-four or more feet if the apartment, motel, or building configuration required. For convenience of factory to job site transport, the width of a floor/ceiling panel 54 could be eight feet; however, if wide or extra wide flat bed trucks can be employed, these panels can be of greater width. The number of joists 58, their spacing, and if they are used back-to-back, as shown in FIGS. 5 and 7, are routine design considerations. However, it is to be understood that no part of these floor/ceiling panels 54 are under loadbearing compression, neither during nor after erection of the building.

Figure 8:
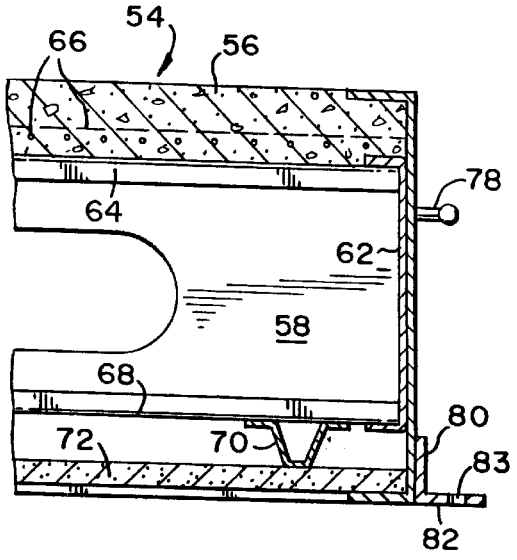
FIG. 8 is an enlarged view of the right end of FIG. 6 of the floor/ceiling panel.

The opposite ends of the spaced joists 58 and 60 are secured to C-shaped, eight inch deep, steel tracks 62, which run the width of the floor/ceiling panel 54, as shown in FIGS. 5 and 8. The side joists 60 are secured to the tracks 62 to make an interior, rectangular frame for the panel 54. As seen in a broken-out portion of FIG. 5 and in FIGS. 6 to 8, mounted onto the top edge 64 of the joists 58 and 60 is Steeltex® mesh 66 to cover the entire top surface of the frame defined by the tracks 60 and 62. Over the Steeltex® mesh lies the concrete floor topping 56, approximately two inches thick, which is poured at the factory as part of the prefabrication. Secured to the bottom edges 68 of the joists 58 and 60 are a plurality of standard manufactured, resilient metal channels 70. By being resilient, the channels 70 reduce the transmission of sound through the floor/ceiling panel 54 from one level of the building to another level. Mounted to channels 70, and spaced from the bottom edges 68 of the joists 58 and 60 is the ceiling board 72, for example ⅝ inch type-X wallboard. The approximate one and one-quarter inch spacing between the ceiling board 72 and the joist improves the fire rating of the floor/ceiling panel and also further reduces sound transmission between levels of the building.

A pair of twelve inch deep steel tracks 74 run the width of the floor/ceiling panel, parallel to the tracks 62, and are secured thereto by spot-welds or screws, (not illustrated). Similar tracks 76 are secured to the joists 60 and form, with the tracks 74, a rectangular frame around the exterior edges of the floor/ceiling panel 54. This rectangular frame, when filled with the concrete topping 56, can be finished economically with a hand screed, using the top of the tracks 76 as a guide. No power finishing is required. Stud anchors 78 and steel, L-shaped angle members 80 are secured to and project outward from the exterior track 74. The angle members can have legs of two inches, be one-eighth inch thick, and extend the width of the floor/ceiling panel. The horizontal leg 82 of the angle member 80 has, along its length, spaced drill holes 83 shown in FIG. 8, for reason to be explained hereinafter. As stated above, the width of a floor/ceiling panel 54 lies along the length dimension of a room and is limited by the width of the flatbed trailer, which transports it from factory to job site. Even if a very wide load bed was employed, the approximate twelve foot panel width would cover only a portion of the needed floor/ceiling surface. Hence, at the job site it is necessary to position several of these panels 54 side by side, with their tracks 76 abutting, to complete the layout of a single apartment or motel unit. After several floor/ceiling panels 54 are properly positioned side by side for a specific single level of the building, the track 76 of one floor/ceiling panel can be welded at spaced apart points to an abutting track 76 of the next floor/ceiling panel 54A as shown fragmentary in the lower right corner of FIG. 5. The tracks, 62, 74 and 76 can be sixteen gage. Although concrete has been chosen for the preferred embodiment, it and the Steeltex® can be replaced by other materials capable of factory prefabrication of the floor/ceiling panel; for example, gypsum can be poured on top of an underlayment board that is secured to the top edge of the joists.

Figure 9:
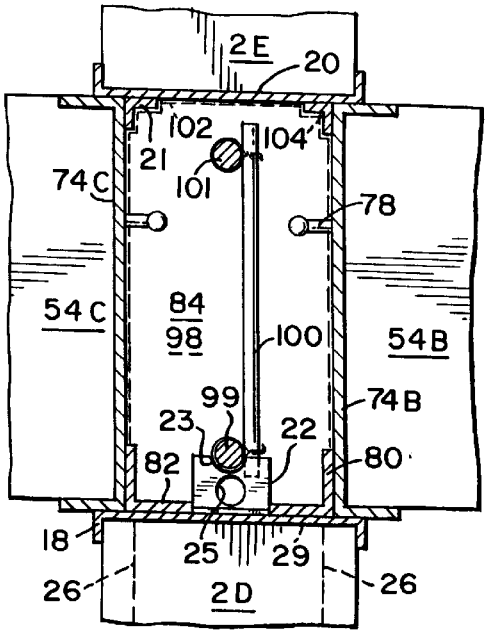
FIG. 9 is a vertical section through portions of two levels of wall panels and the interposed floor/ceiling panels for defining the beam void.
Figure 10:
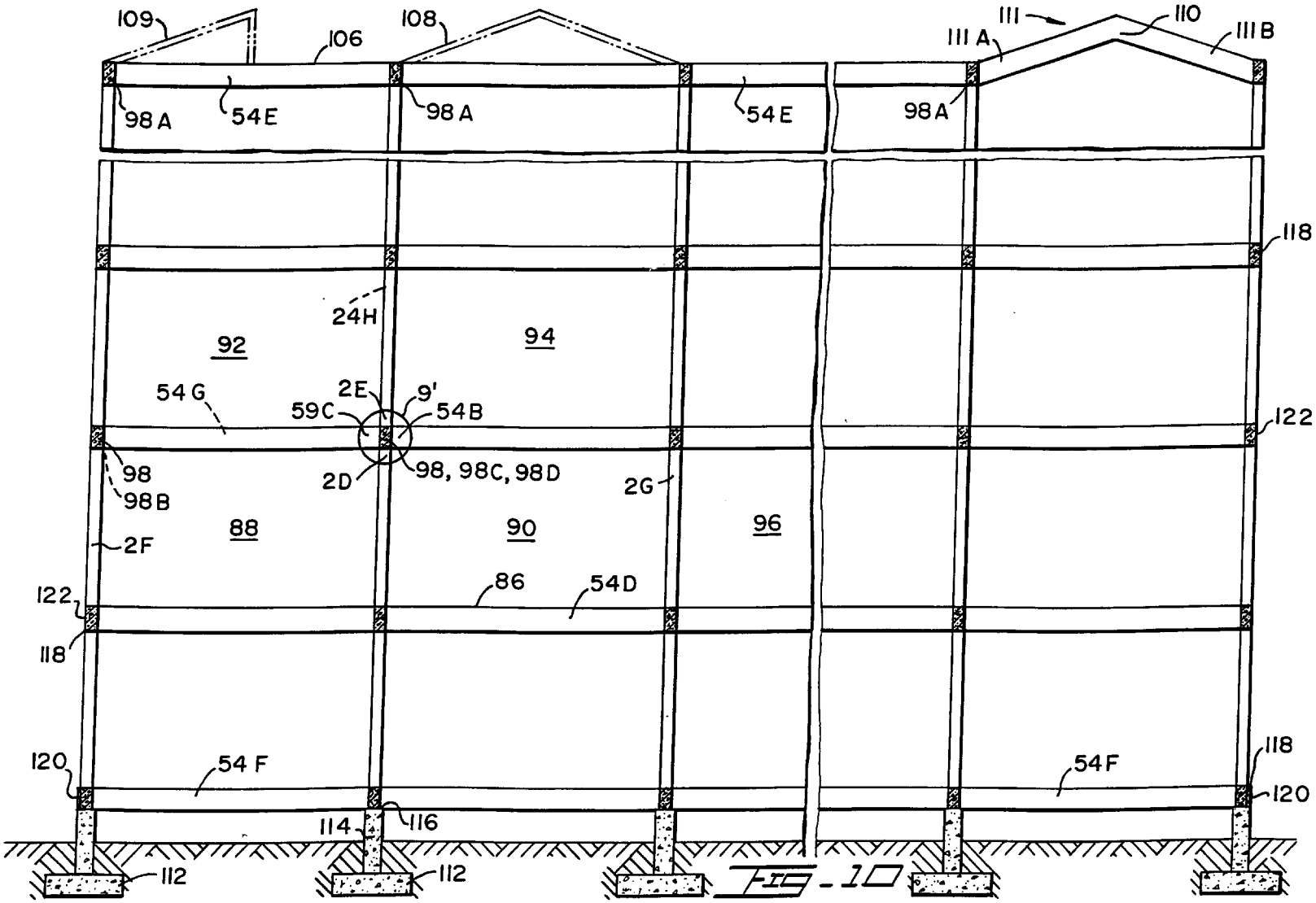
FIG. 10 is a vertical section, somewhat diagramatic, of the side of various levels of a building, such as a motel.

FIG. 9 is a vertical view through small portions of two vertically aligned wall panels 2D and 2E of two levels, for example the second and third levels, of the building and the adjacent ends of two floor/ceiling panels 54B and 54C, which separate these two levels. The portion of the building shown in FIG. 9 is shown by the encircled reference 9' in the building vertical section FIG. 10. For ease of viewing and understanding the creation of a volumetric void 84 for a beam, according to an important feature of this invention, many of the panel components shown in FIGS. 1–8 are not illustrated in FIGS. 9 and 10. Also, most section shading is omitted in FIGS. 9 and 10. During the erection of the building, for example the second level, the vertical wall panels, one of which is the illustrated, interior, loadbearing panel 2D, is positioned on top of a previously positioned floor level 86 (shown only in FIG. 10) composed of a plurality of floor/ceiling panels 54D. Similarly, several other wall panels, exterior 2F and interior, and any core modules required for a complete room unit 88 are erected by the crane and positioned to form that second level room unit. Such positioning will include inserting the stud anchors 42 of one panel into the open slots 44 of the side 26 of the end column frame 24 of an abutting wall panel, as described hereinbefore with reference to FIG. 4. Then, the floor/ceiling panels 54, including 54C for that room unit, are lowered into position by the crane to create the ceiling of the second level and the floor of the third level. As shown in FIG. 9, the horizontal leg 82 of the angle 80 helps position the right side bottom of the floor/ceiling panel 54C onto the optional top track 18, or the basic track 14 if the optional track is omitted, of the wall panel 2D. The clips 22, which are secured along the centerline of the top of the optional track 18, or the basic track 14 if the optional track 18 is omitted, act as positioning alignment stops for the right end of the floor/ceiling panels, such as the panel 54C, by stopping the right edge of the leg 82 from movement inward, once the leg 82 abutts the clip 22. The thus positioned floor/ceiling panel 54C now can be secured to the top of the wall panel 2D by screws, which pass into the drill holes 83, in the legs 82 of the angles 80, and thread into the tracks 14, 18. Since the leg 82 is two inches wide and the centered clip 22 also is two inches wide, the right edge of the panel 54C, i.e. its track 74C is approximately three inches from the vertical center of the volumetric void 84. At the same time that the right side of the panel 54C is being positioned on top of the wall panel 2D, the left side of the panel 54C with its angle leg 82 (not shown) is guided into position on top of a wall panel 2F at the left side of the room unit 88, as shown in FIG. 10. Since the loadbearing studs 4 easily can support the weight of the floor/ceiling panels 54, there is no need at this time to pour the concrete into the column frames 24, the sides 26 of one column frame being shown in dashed line, in wall panel 2D in FIG. 9. At this time, the exterior track 76 of one floor/ceiling panel can be welded to the abutting track 76 on the adjacent panel; although, such welding and pumping of concrete could wait until more of the panels and/or core modules for more of the room units on the same level are positioned.

Next, the wall panels, for example 2G, and any modules for an adjacent room unit 96, shown in FIG. 10, are erected and positioned, so as to be able to support the floor/ceiling panels for that adjacent room unit, one of those floor/ceiling panels being 54B, the left end of which is shown in FIG. 9. At this juncture, the left end of the panel 54B, with its track 74B, and the right end of the panel 54C, with its track 74C, are perched on top of the track 18, or 14 as discussed previously, of the wall panel 2D; and the tracks 74B and 74C are spaced apart by about six inches. Track 18 or 14 thus defines the base of a rectangle and the tracks 74C and 74B define the vertical walls of that rectangle; such rectangle being the end view of the volumetric void 84. As yet, nothing forms the top of the rectangle. As clearly shown in FIG. 9, the volumetric void 84 does not lie inside of any portion of the wall panel 2D, nor the floor/ceiling panels 54B and 54C. Also, the vertical tracks 74B and 74C are solid (no openings) and lie along the entire horizontal length of the void 84. The tracks 14 and/or 18 run along the top of the panel 2D and have coincident openings 30 overlying the open top of each of the column frames 24. The wall panel 2D can represent a plurality of adjacent/abutting wall panels, joined to form a single, long wall of an apartment or motel unit 88, for example thirty-two feet long, having therein several column frames. Likewise, the tracks 74B and 74C of the floor/ceiling panels 54B and 54C can represent the tracks 74 of two entire groups of those floor/ceiling panels, which make up: the second level ceilings of two apartment rooms or motel units 88 and 90, of which the wall panel 2D is a common wall; and the floors of rooms or units 92 and 94 on the third level, of which the wall panel 2E is a common wall. Hence, the cumulative length of tracks 74B and 74C also can be quite long, for example thirty-two feet long made up of end-to-end tracks from the cumulative, side-by-side relationship of the separate floor/ceiling panels. Accordingly, the volumetric void 84 would lie on top of an entire wall, made up of one or several wall panels 2; and the volumetric void also would lie between the end tracks 74 of two adjacent arrays of floor/ceiling panels 54. Such position of the volumetric void 84 is to become the position of a horizontal, concrete filled beam 98. The beam 98, its reference number line, parts of the beam and their reference number lines, to be introduced hereinafter, are shown in FIG. 9 with short dashed lines to emphasize that they are the result of filling the volumetric void 84 with concrete.

According to a feature of the invention, the pouring of the concrete can be scheduled so that all the columns and all the beams for a specific building level, the second level re FIGS. 9 and 10, are poured during the same time period, a single pour. However, if the construction/erection schedule does not enable a single pour per level, plural concrete pours at different times are accomplishable without negating the primary advantages of the invention. As employed herein, the term "pouring" includes pumping. A preferred construction/erection schedule would complete one building level per day and provide for the erection of all vertical components—loadbearing wall panels, kitchen and/or bathroom core modules—and the positioning of all of the floor/ceiling panels 54 on top of all those vertical components for that one level to be completed during the first part of a workday. Such erection and positioning would include the latching together of the ends of wall panels, as by the stud anchors 42, and the welding together the tracks 76 of adjacent sections of floor/ceiling panels 54. Since the floor/ceiling panels are immediately placed upon and, by themselves, brace the corner connected wall panels, there is little if any need for temporary interior bracing. Also, since the exterior faces of all exterior wall panels are finished completely at the factory, there would be no need for exterior scaffolds. The result of such first part of the workday erection and positioning would be as shown in FIGS. 4, 9, and the second level in FIG. 10 except for the concrete 46 shown in FIG. 4 and the third level wall panel 2E shown in FIG. 9.

During the second part of the first construction day, reinforcing bars, such as 38 and 50 for the columns 48 and bars 99, 100 and 101 needed for the beams 98 would be installed, and any concrete pouring preparation would be accomplished. The lower, horizontal bar 99 is seated in the notched edge 23 of the clips 22; and the vertical bars 100 are tie wired to both of the horizontal bars 99 and 101. The installation of the vertical reinforcing bars 38 and 50, which pass through the column frames and the beam voids (these bars are not shown in FIG. 9) preferably employ "30 bar diameter" overlap, level to level, to tie the levels together and create a complete, reinforced concrete, monolithic framework. It is to be remembered that the wall panels, such as the wall panel 2E of FIG. 9, have not yet been erected, nor has any other part of the third level, other than the floor portion of the floor/ceiling panels 54. The concrete now can be poured/pumped into the volumetric voids 84 from a position near the top thereof. Pumping the concrete into volumetric, beam forming void 84 also causes the concrete to flow into the top of the column frames 24, by way of the openings 30 in the tracks 14 and/or 18. As concrete fills the beam void 84, it also fills the large bore 25 in the clips 22 to provide further anchoring support to the clips, the wall panels 2 and the reinforcing bars 99, 100 and 101. The concrete pumping could proceed simultaneously at several different beam void locations on the same level, so that it is completed during the second part of the workday, and all of the column frames 24 and volumetric voids 84 are filled to make the concrete columns 48 and beams 98 for that building level. After concrete pouring is completed, which includes smoothing the top surface 102 of the resulting beam 98, and the concrete has partially setup, a pair of vertical grooves 104, which run horizontally along the entire length of the beam, are made. In the first part of the following day, the grooves 104 will have hardened to be able to receive the downwardly directed legs of the L-shaped guides 21 for helping the positioning of the third level wall panels, such as the panel 2E.

It will be appreciated that, during the morning of the second day of the preferred work schedule, the concrete poured during the second part of the first day will have hardened, but is not yet structurally strong enough to enable the beams 98 and the columns 48 to become a loadbearing structural framework and assume the role of carrying the weight of the building down to the foundation. This is no problem, since the studs 4 in the wall panels 2 provide sufficient loadbearing to support: those day-before poured columns and beams, the floor/ceiling panels perched/set on those wall panels, all vertical panels and modules of the next level (the third level in this example), and the floor/ceiling panels which will be perched thereon. Moreover, even if the columns and beams poured the first day, second part are not totally loadbearing by the second part of the second day schedule, for the pouring on the third level, the loadbearing capability of those first day columns and beams, combined with the loadbearing capacity of the wall panel studs 4 erected the first part of the first day (for the second level) and the first part of the second day (for the third level) is more than sufficient to support the concrete pouring of the third level columns and beams on the second part of the second schedule day. Based upon this preferred work schedule, an entire building level can be erected and poured in one day, and the next level can be erected and poured the next day. To reduce the time by which the columns and beams of concrete attain sufficient loadbearing strength, the concrete can be of higher psi. rating, such as 5,000 psi, rather than the more commonly used 3,000 psi. Since erection of a level includes its ceiling, and since windows are included in prefabrication of the exterior wall panels, some interior work can progress daily on a level, as soon as erection of that level is completed, independent of weather conditions and even during the concrete pouring for that level. Such interior work could include connection of the factory installed electrical conduits and plumbing piping to main lines, and installation of all non-loadbearing walls, which were prefabricated in the factory, transported to the site, and lifted into place as a strapped bundle of walls and placed on the previously erected floor panels of the appropriate living unit, prior to closing the ceiling of that unit with the floor/ceiling panel above. These interior non-loadbearing walls or partitions are fabricated similar to bearing walls, but without the inclusion of any column frames. They are light in weight, with twenty-five gage studs, and can be tilted up into position by hand, by a separate crew, so as not to deviate from the accelerated schedule of completing and weatherproofing the main building structure.

If the number of walls and modules on any one level of the building is too large for erection to be completed in the first part of a workday, the pouring of the columns and beams can commence where erection has been completed on the same level, on the same workday; while erection is being completed during the second part of the same day. After erection of the third level walls and modules and the pouring/pumping of the concrete for the beams and columns of the third level, the same procedure is repeated for the fourth level; and again is repeated for each higher level.

Several solutions are available for capping the top of the building with a roofing system. The structural integrity of the building must be complete by creating and pouring all the beam voids 98A to encapsulate the building and thus bind the various components into a continuous monolithic structural unit. Three basic solutions are available. One solution is to cap the building with a flat roof utilizing a floor/ceiling panel 54 as a roof panel 54E, as shown in FIG. 10 with added roofing finish. A second solution is to add optional, conventional sloping roof members 108, upon which conventional roofing panels can be secured. The conventional sloping roof members would be in addition to the beam void forming panels 54E. This second method would allow mansard type roof edges 109 to be accomplished economically. A third solution, which could be the preferred solution, would be to modify panel 54E as a sloping roof system. This roof/ceiling panel would be manufactured similar to the standard floor/ceiling panel 54, as described in FIGS. 5–8, with one major exception. All floor joists 58 and 60 and tracks 76 would be made in two half parts which are fastened end-to-end with a raised, rigid or hinged joint 110 at an apex and two identical sloping sides 111A and 111B, as shown in FIG. 10. The resulting sloped roof/ceiling bent panel 111 would be fabricated similar to the floor ceiling panel 54, so that the end tracks 74 are maintained in their vertical position to help form the beam void 98A. A finished roofing can be applied at the factory and the whole, bent, rigid or hinged panel 111 can be transported and erected rigid or folded in one piece, without need for any external scaffolds. Once all of the roofing is completed, the entire building is water/weather tight and ready for final interior finishing including: drywall touchup spackling of nicks and blemishes on the previously finished wall panels and ceiling panels; spraying on any popcorn ceiling and spray painting the walls; laying carpeting; hanging prefinished interior doors; and completing the electrical wiring connections, air conditioning ductwork connections and plumbing connections.

FIG. 10 illustrates one of the various typical foundations which can be employed with the components and method according to the present invention. Concrete spread footings 112 can support a concrete stem wall 114, which would support the first level of floor panels 54F. The floor panels 54F would be prefabricated the same as the floor/ceiling panels 54 in FIGS. 5–8, except that the resilient channels 70 and the ceiling wallboard 72 are omitted. The bottom edge of the volumetric beam voids 84 for the first level is defined by the top surface 116 of the stem wall 114, since there is no wallpanel 2, with its track 18 below the floor level 54F, as there is in the second and higher levels, as previously was described and shown in FIG. 9.

The outside faces 118 of the beam voids 84 require some form-like element while concrete is being poured and until it has hardened. For the first level beam voids, a standard, temporary form 120 can be used and then removed.

However, this is not acceptable for the upper levels, since a goal of the present invention is the exclusion of exterior scaffolds. A solution for this problem is to factory install an external metal track 122, also shown in FIG. 2, hinged or fixed, so that in its final position it completes the forming of the beam void.

A top, sectional view of a typical motel room is shown in FIG. 11, such as the third level room unit 92 in FIG. 10, with a small portion of an adjacent room unit 94. The motel room 92 has two main portions, a living/sleeping portion 124 and a core module 126 which encompasses a bathroom/entry/closet portion. The living/sleeping portion 124 contains all of the structural components illustrated and described heretofore, except for the footings, stem walls and roof. Commencing with the left wall, it is formed by one or a series of end connected, exterior. loadbearing wall panels 2A, with light gage studs 4, sound deadening and wall boards 6 and 8, fiberglass insulation 10, exterior sheathing board 11, finishing 12, reveal 13, at least the basic tracks 14 and 16, the column frames 24 (interior and end) filled with concrete 46, the interconnection cap screws 40 and stud anchors 42, etc., etc. Underlying the wall panels 2A is the beam void 84 filled with concrete to constitute a beam 98 running the entire length of the room 92. The concrete for the beam 98 was poured at the same time as the concrete which filled the column frames 24 for the columns in the panels 2 in the lower level room units 88, 90 and 96.

The long wall on the right side of the room unit 92 is an interior/common wall made of one or several end-to-end interior, loadbearing wall panels 2C, of the type shown in FIG. 1, withe the sound deadening and Type-X wallboards 6 and 8 on both sides thereof and the construction components just above mentioned for the left wall. Within the circled reference 3' is an interior column frame 24, shown in FIG. 3. The exterior lateral wall is of the 2A type, was prefabricated with a finished window 128 and an opening 130 for receiving an air conditioning unit 132. The corner, to the right of the A/C unit 132, where wall panels of the type 2A, 2B and 2C are joined together, is similar to that which is illustrated in detail in FIG. 4 and is identified by the circle reference 4' in FIG. 11. The circle reference 5' points out the floor portion of the floor/ceiling panel shown in FIGS. 5–8. The long dashed lines 76, one of which passes through the circle 5', designates the exterior tracks 76 of two of the floor/ceiling panels which are secured to each other, to join two of the floor/ceiling panels 54.

The length of a room unit is not dictated by the length of room units adjacent, below or above it. Also, the exterior end of a room unit can be extended to include a balcony; these two features are shown in the top of FIG. 11. Beam voids and their resulting beams, such as 98B and 98C, are extended and cantilevered from the longitudinal beams 98 to extend outward from an exterior wall and be covered by a prefabricated concrete slab 134, or a floor panel similar to the floor/ceiling panel 54, but with a weather-tight lower surface replacing the ceiling board 72, to form a balcony. Although the beams 98B and 98C are cantilevered and require the use of removable forms, there is no need for exterior scaffolds. Presence of the balcony would require the window 128 to be a sliding glass door, prefabricated and installed off site into its exterior wall panel. If the room unit 94 is to be longer than the unit 92, its longitudinal beams, one of which is 98C, can be extended in the same way as the balcony beams 98B and 98C. Of course, other of the construction components, including side walls, floor and ceiling, also would be longer, and the exterior wall 2B would be moved outward to the position 2B'. The bottom surface of balconies and extended rooms would be finished suitably. The presence of different room unit lengths and balconies allows for variation in the design of the facade of the building.

A core module, one example being the bathroom 126 in FIG. 11, according to the present invention, utilizes many of the prefabrication techniques and components described hereinabove and obviates prior art complexity and cost. The advantage of a core module, such as the bathroom 126, is that it is totally prefabricated. Tiled floor, ceiling, walls, tub/shower enclosure, sink, toilet, mirrors, all plumbing pipes and electrical outlets, conduits and fixtures are assembled off site into one totally finished, six sided, modular unit; ready to be set into final position by the job site crane. The major disadvantages of prior art modules did not pertain to their prefabrication and transport, but were caused by their installation requirements. According to the prior art, the modules were selfsupporting, but were not loadbearing; they could not support the weight of modules or rooms or steel/concrete framework above them. Hence, the prior art six sided modules had to be placed into a loadbearing framework or shell, which already was part of the building being erected; or a loadbearing framework or shell had to be formed around the prefabricated module just after it was set into the building, as it was being constructed. This effectively created a box within a box; thus requiring considerably more work, materials and weight—hardly much of an advantage when using modules. Or, if the module was of heavy concrete shell type and could support additional modules above, then it would be extremely heavy and large and be difficult to transport. Core modules, according to the present invention, are loadbearing, since their wall panels 2 contain the loadbearing studs 4 and the column frames 24, which will be filled with concrete and thereby become loadbearing. Or, in the alternative, as earlier discussed, the studs can be of the increased strength, thereby obviating the need for the concrete columns, or reducing the number of the columns. Components of the modules define the volumetric beam void 84, which is filled with concrete to form the beam 98. In fact, from an examination of FIG. 11, the bathroom portion core module 126 does not look to be of different construction than the living/sleeping portion 124, except for the narrow side-by-side walls 2H and 2I, which lie on top of the beam portion 98D, which is contiguous with beam 98, which underlies the entire right side of the room unit 92 and the left side of the room unit 94. As is well known, to simplify plumbing, bathrooms of adjacent room units are positioned back-to-back; also, they are vertically aligned floor-to-floor.

The core modules shown in FIGS. 11 and 13 span the full width of a room—span from bearing wall to bearing wall. Core modules can be shorter or longer and span across and interrupt a bearing wall if the plan layout so dictates. An example would be two bathrooms back to back serving two living units and factory fabricated into one module for economy. In this case the bearing wall separating the two living units would be interrupted by the intersecting module. This presents no problem structurally as long as the beam void continues into the perimeter of the module, completes the beam void along both sides of the module and connects it into any adjacent bearing walls that abutt the module. This encapsulates the module and binds all the beam voids of a particular building level into one contiguous, monolithic, structural unit.

The vertical, sectional view in FIG. 12, which is taken along the line 12—12 in FIG. 11, provides more information concerning the construction features of the core module wall panels 2H, 2I, 2J and 2K, ceiling and floor members 54G and 54H and their small differences from the wall panel 2, shown in FIGS. 1–4, and the floor/ceiling panel 54, shown in FIGS. 5–8. The essence of the differences in the major components is that the bath module 126 and all other core modules according to this invention are six sided and, therefore, do not share a common wall, or a common ceiling or floor with an adjacent core module. Thus, the bathroom module 126 in motel room 92 requires a wall panel 2H, which is prefabricated as one of its module's six sides; and it is fabricated totally separate from the similar wall panel 2I in the six sided bathroom module 136 for the motel room 94, as is shown in FIGS. 11 and 12. The bathroom module 126 in FIG. 11 is at the corner of the motel and, therefore, only the wall panel 2H is adjacent another core module; hence, the remaining loadbearing wall panels 2 of this module are either interior, as shown in FIG. 1, or exterior, as illustrated in FIG. 4. So that the beam void 84D and the resulting beam 98D running below the wall panels 2H and 2I have the same six inch width as all the other beam voids and beams in the motel building, the wall panels 2H and 2I are approximately one-half the width of the previously described wall panels 2. Thus, the loadbearing studs 4H and 4I are two and one-half inches wide and are set into two and one-half inch wide steel bottom tracks 16H and 16I. Likewise, the top of the studs, such as shown as 4J and 4K, over which the beam 98D is positioned, are set into top tracks 14J and 14K. The wall panels 2J and 2K are part of two other back-to-back core modules 138 and 140, located at the ends of the motel rooms 88, and 90. As is well known, to simplify plumbing, bathrooms of adjacent room units are positioned back-to-back; also, they are vertically aligned floor-to-floor. There are no optional tracks 18 and 20. The L-shaped guides 21 are secured to the bottom tracks 16H and 16I and their respective floor tracks 74, to facilitate factory fabrication of the totally enclosed modules. Since the core modules are totally finished as part of their prefabrication, bathtubs 142, and floor tile 144 are part of the bathroom module 126, as well as sinks, toilets, mirrors, wall tile, light fixtures, floor and wall cabinets (not illustrated), etc.

Since core modules are not limited to encompassing a single room, such as a bathroom or a kitchen, a core module can encompass, for example, two back-to-back bathrooms 126 and 136 in the motel units 92 and 94. In such an arrangement, the narrow wall panels 2H and 2I could be replaced by a single common interior wall panel 2. Such a core module need not include the entry and closet portions of the rooms.

Each core module has its own floor panel 54G and its own ceiling panel 146. As shown in FIG. 12, the floor panel 54G is almost identical to the floor portion of the floor/ceiling panel 54 shown in FIG. 8. The floor panel 54G is composed of an eight inch wide steel joist 58, set within a pair of C-shaped, eight inch interior tracks 62, which are secured to two pair of C-shaped exterior tracks 74 and 76, which frame the floor panel 54G. Steeltex® mesh 66 is secured to the top edge 64 of the joists. About two inches of concrete topping 56 is poured on top of the Steeltex mesh and is the smooth base for the tile 144. Also, stud anchors 78 are secured to the exterior track 74. The L-shaped angles 80 are secured as also shown in FIGS. 8 and 9, so as to butt against the side edges of the clips 22. The ceiling panels 146 of a core module comprise a light gage steel joist 148, for example six inches deep, set into a frame of six inch, C-shaped steel tracks, of which the tracks 150 are shown in FIG. 12. The top of the ceiling panel of a core module, for example the bathroom module 138 of the second level room unit 88, is approximately two inches below the top of its wall panel 2J (as well as below the top of the adjacent wall panel 2K of the module 140 of the room unit 90). Thus, the side tracks 150 of the ceiling panels 146 of a core module cannot form any part of the beam void 84D. Only the side tracks 74 of the floor panels 54G define the vertical sides of this beam void. The bottom surface of this beam void 84D is defined by a closure plate 152, which can be sixteen gage and is secured to the top faces 154 and 156 of the top tracks 14J and 14K. The closure plate is prefabricated with attached two by two L-shaped clips 22, as previously described and shown in FIG. 2, and is pre-punched with openings 158, positioned over any column frames, such as 24J in FIG. 12. The openings 158 are for the same purpose as the openings 30 in the tracks 14 and 18 discussed with FIG. 3—to establish an opening into the top of the column frames for pumping therein the concrete. This enables all beam and column members in the core modules to be contiguous throughout the vertical height of the building and also to be contiguous with all other of the beams and columns in the same and all other levels of the building; thus forming a single, unitary, reinforced concrete framework. Wallboard 160, for example ⅝ inch Type-X, finished as required, is secured to the lower edge 162 of the joists, to form the ceiling. The walls of the modules can include sound deadening board 6 and finished Type-X wallboard 8, unless other wall finishes are specified by the builder.

Because of the narrow, two and one-half inch, width of some of the module studs, such as 4J and 4K and the resulting narrow wall panels 2J and 2K, there is insufficient space to place a full size, five inches square or rectangular, column frame 24 or even a smaller three inch column frame within one of these wall panels. Moreover, the column frame and its resulting loadbearing column should be centered with respect to the vertical axis of the beam 98D. To accommodate for these needs, as shown in FIGS. 11 and 12, the column frames, such as 24H and 24J, are secured within one of the side-by-side module wall panels, such as 2H and 2J, and project between the studs 4I and 4K of the adjacent wall panel, 2I or 2K, respectively. Since the entire floor of a particular room unit, such as 92 in FIG. 10, is to be installed completely prior to the pumping of any beam voids 84 at that floor level (the third level in FIG. 10), then all the floor/ceiling panels 54 in the living area 124, and the floor panel 54G of the core module 126 are to be put in place prior to pumping the beam voids associated with that floor. However, when the bathroom core modules 126 and 136 are in place, the beam void 84D defined by the floor tracks 74 and closure plate 152 of the modules 126 and 136 is not accessible for pumping from that floor level. Since the beam voids which form the perimeter of a particular room unit should be filled with one uninterrupted continuous pour, filling of the beam void 84D can best be accomplished by pumping into the top of the column frames 24H, which are shared by the two modules 126 and 136 and are spaced within the module wall panels 2H and 2I. Once the beam 98D is poured, then the remaining beam voids 84 surrounding the perimeter of the living portion 124 can be pumped from the floor level directly, as described previously. As a consequence, for a specific building level, the installation of a core module precedes by one full, two part, construction/erection cycle the erection of the wall panels 2 and the floor/ceiling panels 54 set onto their tops for the non-module portions of that same building level. Hence, when concrete is poured for the beams of a specific building level, the columns, which are a part of a module and rise above those beams also partially are poured. For example and with reference to FIGS. 10–12, when the second level rooms 88, 90, 96, etc. are being erected with their wall panels 2F, 2D, 2G, etc. and their floor/ceiling panels 54C, 54B, etc. during a first part of a construction cycle, the bathroom module 126 for the third level room 92 also is positioned, so that its floor panels 54G are horizontally aligned with the floor/ceiling panels 54B, 54C, etc., at the top of the second level. Then, during the second part of the same construction cycle, the concrete is poured into the beam voids 84 for creating the beams 98, 98B and 98C, which lie along the top of the rooms 88, 90, 96, etc., and concrete also is poured then into the top of the column frame 24H of the core module 126 for creating the beam 98D, within the beam void 84D, which was defined by the floor panels 54G and their closure plate 152 of the module.

In some instances, especially in buildings of many floors, the allowable compressive bearing strength of the concrete beam 98 might be exceeded where it horizontally passes between the vertically aligned column frames 24, filled with concrete, which define the loadbearing columns 48. In such case, the architect or structural engineer can employ a bearing, compression fitting 163, as shown in FIG. 13. This FIG. 13 is a repeat of FIG. 9, with certain components of FIG. 9 not shown, for enhancing the illustration of the compression fitting 163. The compression fitting 163 lies in the beam void 84 directly in vertical alignment with the column frames below and above it, for example the column frames 24D and 24E and their columns 46D and 46E, in their respective wall panels 2D and 2E. The task of this compression fitting is to transfer the building loads directly from an upper column, such as 46E, down through this compression fitting and into the underlying column, such as 46D. Three components make up the compression fitting, a pair of legs 164 and a top bearing plate 165. The legs 164 can be cut from a standard four inch steel channel; and the top bearing plate 165 can be of three-eighth inch steel. The tops of the legs are welded to the bottom side of the bearing plate. The overall height of the compression fitting is to be equal to the height of the beam void 84, so that the top surface of the bearing plate 165 is in surface contact with the bottom surface of the flanges 29E. The flanges 29E are the only components of the bearing box 31 employed when using the compression fitting 163. Also, the flanges 29E are to extend out from the bottom of the column frame 24E, since there are no sides 32, as shown in FIG. 3. The bearing plate 165 has a centered opening 166, which would be aligned with the opening 36 in the track 16 of the wall panel 2E, and the opening 30 in the track 14 of the wall panel 2D, so that the reinforcing bar 38 will pass totally through the fitting 163 and be spliced with other vertically aligned reinforcing bars in the wall panels 2D and 2E. The assembled compression fitting 163 is installed in the beam void 84 prior to the pumping of concrete therein; the pumped concrete would become contiguous with that of the columns 46D and 46E.

Figure 14:
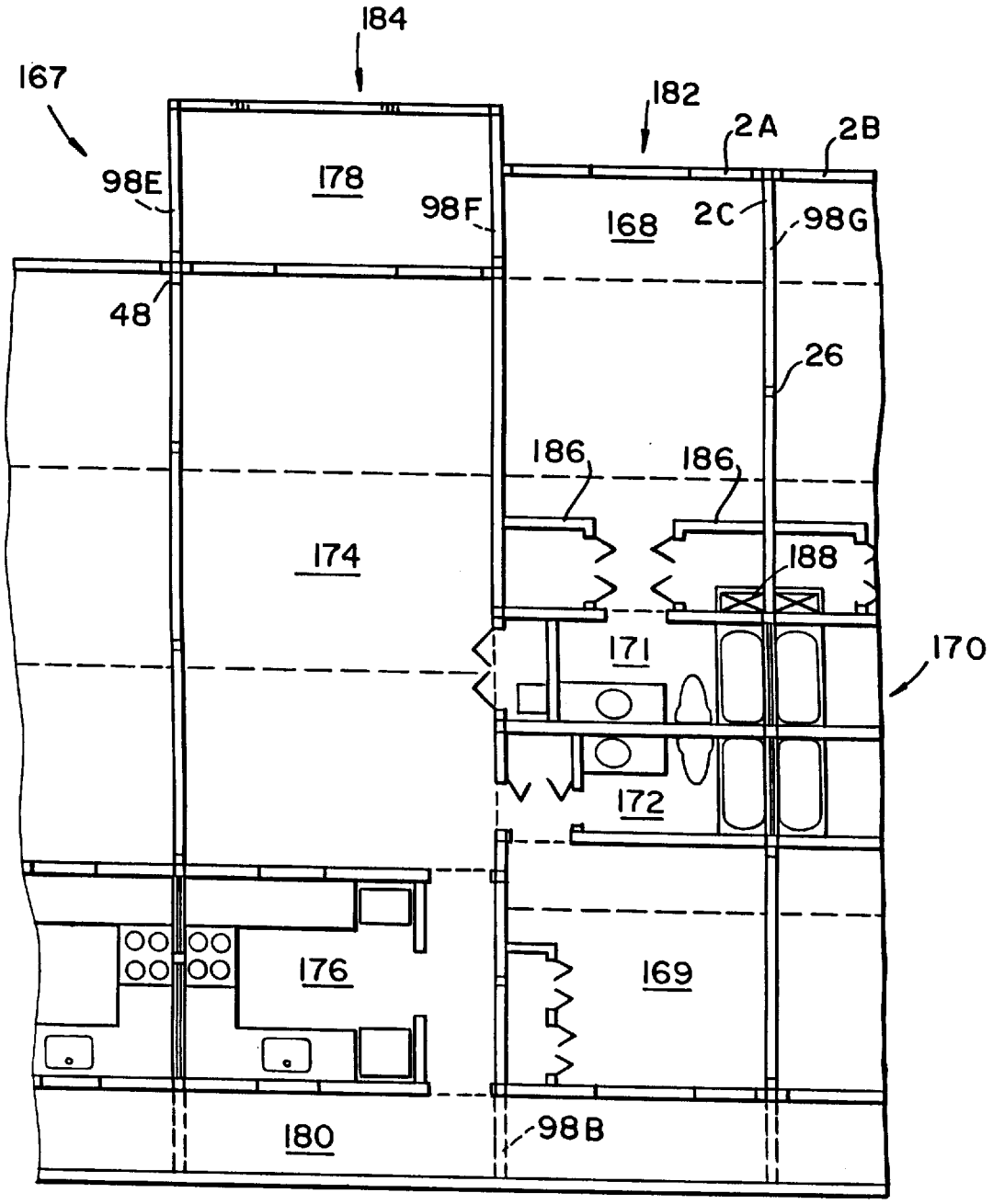
FIG. 14 is a top, sectional view of a typical apartment.

FIG. 14 depicts a typical apartment 167, having two bedrooms 168 and 169, each sharing a single back-to-back bathroom core module 170 with its bathrooms 171 and 172; a large living/dining area 174; a core module kitchen 176; and a balcony 178. Also shown is an exterior corridor 180. This apartment 164 would consist of all of the factory prefabricated panel, modules and components described hereinabove and illustrated in FIGS. 1–13. Most importantly: the method of defining the beam voids; creating light weight steel column frames, which become bearing components when filled with concrete; using loadbearing studs in the wall panels; and avoiding exterior scaffolds, contribute to lower costs, faster erection and completion and a totally satisfactory, high quality building. The overall size of the apartment 167 is approximately thirty feet wide and forty-four feet long, including two spans 182 and 184, fourteen and sixteen feet, respectively, with three beams 98E, 98F and 98G running the lengths of these spans. Of course, an apartment can be composed of many more than two spans and, therefore, be much wider than thirty feet; and also be as long as one wants, by use of the end-to-end wall panels and many sections of the floor/ceiling panels. The exterior corridor 180 is constructed similar to the balcony 178, with on-site extended, cantilevered beams 98B and reinforced, concrete slabs, as discussed with reference to the balcony 134 in FIG. 11.

The apartment 167, as well as the motel unit of FIG. 10, contain some non-bearing, interior wall partitions, factory prefabricated and finished, as previously discussed. Examples of these partitions are closet walls 186 in FIG. 14. These wall partitions also can be used to enclose vertical chases 188, for plumbing and/or other utilities. A chase can be built within a core module, shown as 190 in the bathroom module 126 in FIG. 11.

Typically, most apartment buildings, hotels and motels have lobbies, foyers, meeting rooms, and other large open areas, which should not be divided by wall panels, nor be interrupted by load supporting columns. Conventional on-site construction could be used to build the large open areas, but at a greater cost and at loss of the time efficiency of the present invention. However, with small modification to certain of the wall panels 2, to make them into trussed panels; and by using beam supporting reinforcing bars depending from associated wall panel columns, the construction method and components set forth hereinabove, with reference to FIGS. 1–14, can be employed to their full advantage to define the desired, inventive monolithic load supporting framework system having therein large open area rooms, as well as normal sized rooms, units and apartments.

Figure 15:
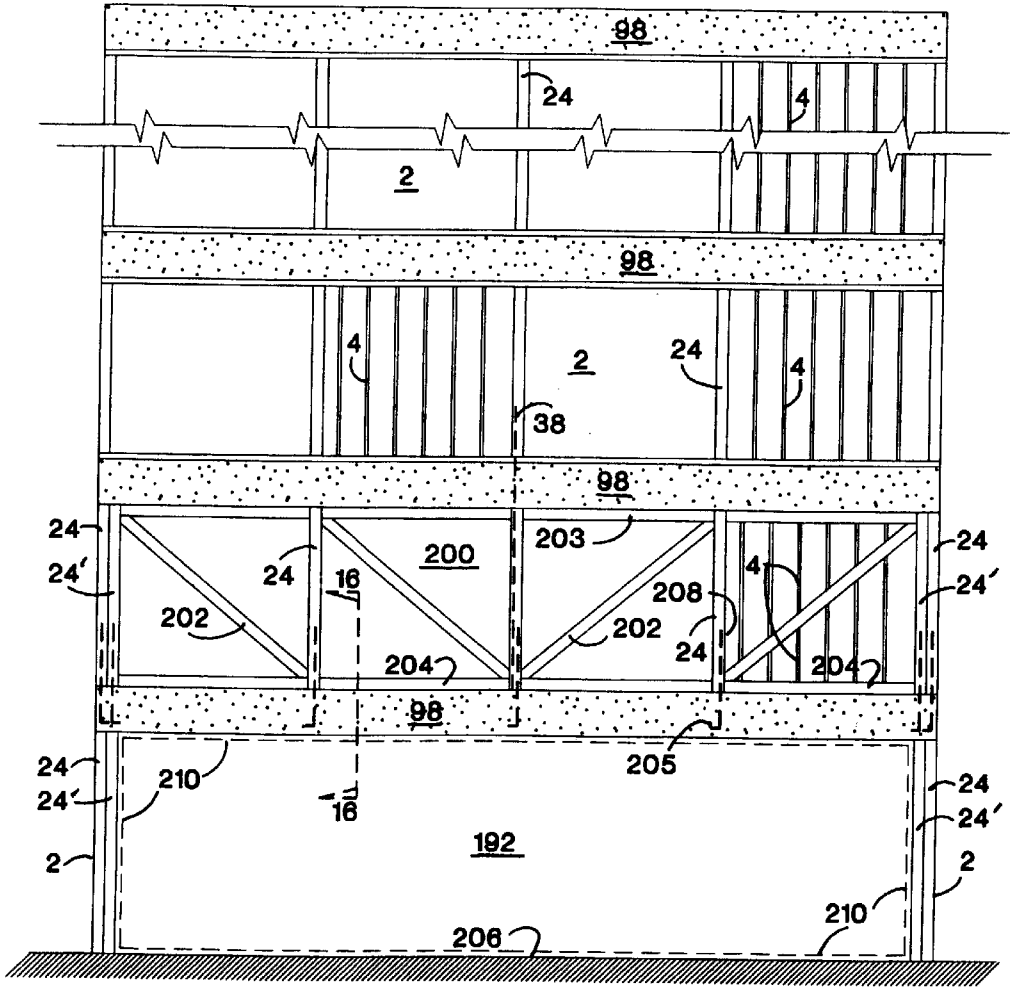
FIG. 15 is a vertical section, of a transverse view of the building shown in FIG. 10.

With reference to FIG. 15, a vertical section through the building shown in FIG. 10, but at right angle to it, i.e. a transverse view, let it be assumed that on the first level there is to be an open area lobby 192 below the rooms 88,90 and 96 (shown in FIG. 10). The left end of the lobby 192 will be at the end of the building. Since the lobby is to be an open area, without supporting wall panels 2 or columns, the load of the building from above would be too great to be supported by only the outside left wall, with its wall panels 2 their studs 4 and their concrete filled column frames 24, and also the load supporting walls and columns vertically aligned with the right side of the room 96—from ground to roof, with their respectively associated beams 98. With reference to FIG. 14, and assuming its apartment 167 also is the room 90 in FIG. 10, the lobby 192 would have no load bearing wall panels 2 or even columns aligned under and thereby supporting the walls 194, 196 and 198, which run the entire length of the apartment 167. Nor would there be in the lobby any supporting walls or any support members under the walls corresponding to wall 196 in rooms 88 and 96.

Figure 16:
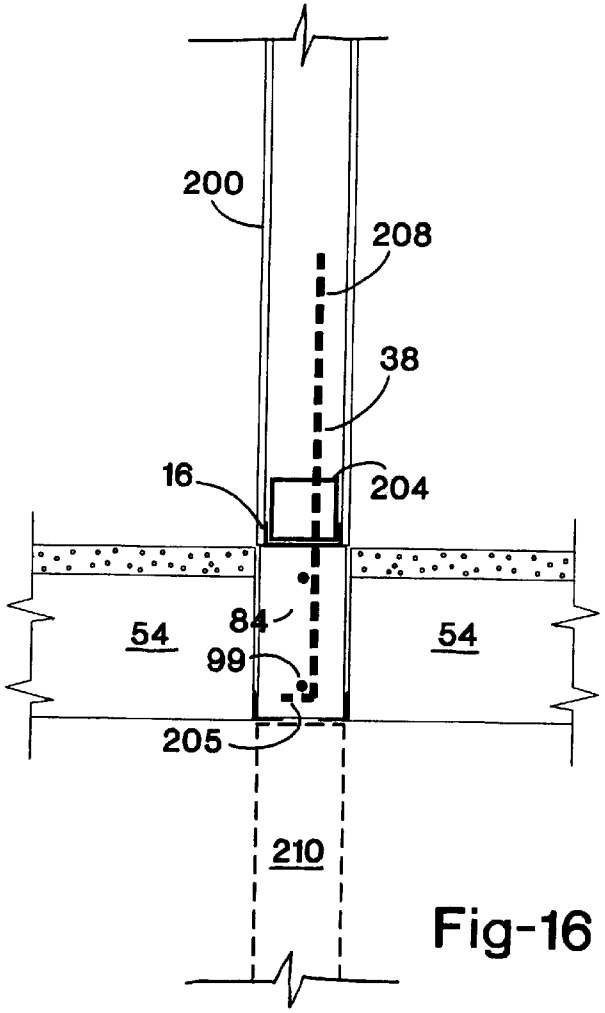
FIG. 16 is a vertical section, similar to FIG. 9, showing especially a portion of a trussed wall panel and a supported beam below, taken along the line 16—16 in FIG. 15.

The absence of wall-column support in the lobby 192 can be replaced by a modification of the wall panels forming walls 194, 196 and 198 in the overlying rooms 88, 90 and 96, by fabricating those wall panels as trussed wall panels 200, designed as a girder truss, shown in FIGS. 15 and 16. Such trussed wall panels 200 are to be fully fabricated off site —at the factory—as are all of the wall panels 2. A diagonal chord member 202, preferably of steel, is welded to similar top chord and bottom chord members 203 and 204, which are secured to tracks 14 and 16; these tracks having been previously described with reference to FIGS. 2 and 3.

Although the chords 202, 203 and 204 could be cut from a steel angle of suitable dimensions and strength, the shape and material of the column frame 24 (shown in FIGS. 1 and 3) meets the structural needs and is easily fabricated to correct length. The trussed wall panel 200 would be designed according to basic engineering practice, which includes use of basic truss principles for defining the size, type and location of the truss chord members. As shown in FIG. 15, the studs 4 are present, but are interrupted by the diagonal chord 202 and are secured to the top and bottom chords 203 and 204. They no longer are the needed for load support. Further support, if needed can be provided by additional column frames 24' adjacent to the end column frames 24, in one or both the ends of the lobby and in the wall panels 200 lying directly thereover, as shown in FIG. 15.

The trussed wall panels 200 will support the building loads thereabove, remembering that they will contain the studs 4 and the concrete columns 46 in the steel frames 24. However, and with reference to FIG. 9, the concrete beam 98 lying between the floor/ceiling panels 54B, 54C, just below the wall panel 2E, if it was a trussed wall panel 200, could not support itself without a supporting wall panel 2D or other supporting members or columns. To solve this new problem, the vertical reinforcing bars 38 (shown in FIGS. 1, 3 and 4) are formed with a depending hook 205 and, as shown in FIG. 16, will be positioned just hooked below the horizontal reinforcing bar 99 (first shown in FIG. 9), to lock into and support those beams which are just above the lobby 192.

The erection and pouring method described hereinabove with reference to FIGS. 1–14 also is to be followed when using the trussed wall panels 200 and the reinforcing bars having the hooks 205. Those reinforcing bars would be the bottom/lowest of the 30 bar diameter overlapped bars 38 and would be set into the positions shown in FIGS. 15 and 16, relative to the horizontal bars 99, during the first part of a "first" day, prior to pouring concrete, on the second part of that day. Such pouring, as previously described, would be from above and into the beam voids 84, just above the lobby 192; and would flow down through the column frames 24 in the bearing wall panels 2 surrounding the lobby 192, down to the ground floor 206. However, at that time of pouring, the hooked reinforcing bars have no beam supporting ability, since their upper ends 208 are not encased in hardened concrete. That encasing concrete will not be poured until the next day and will not be sufficiently hardened for at least another day thereafter.

The needed beam support, during erection and pouring around and directly above the lobby 192, as well as during the next day's erection of the trussed wall panels 200 and the pouring of the beam overlying them, down into their column frames 24 to encase the upper ends 208 of the reinforcing bars 38, and for at least the next day, until the hooked bars can support the beams 98, is provided by temporary wall panels 210 which are erected during the first part of the "first" day, when other wall panels 2 are being erected around the periphery of the lobby and at all other locations on the first level, for defining walls of rooms. With reference to FIG. 9, if the floor/ceiling panels 54B, 54C were to overlie the lobby 192, then the wall panel 2D would be a temporary wall panel 210. As shown in FIG. 15, one or a series of the temporary wall panels 210 form temporary walls aligned below the trussed walls formed by the trussed wall panels 200. With reference to FIG. 14, the trussed wall panels are aligned one level below the longitudinal running walls 194, 196, 198, etc. in the rooms 88, 90, 96 and the temporary walls defined by the temporary wall panels 210 are aligned below the trussed wall panels 200.

The temporary wall panels 210 can be fabricated similar to the wall panels 2, having the loadbearing metal studs 4, but they do not require the: column frames 24, outer tracks 18, 20, sound deading board 6, insulation 8, exterior finish 12, guides 21, clips 22, nor wall board 24. After the concrete beams 98 and columns 46 overlying and surrounding the lobby and those columns in and beams just above the trussed wall panels 200 have sufficiently hardened to support the beams 98 just above the temporary wall panels 210, the temporary wall panels can be removed and the lobby can be decoratively finished. Thus, the creation of the large area, lobby, has not importantly modified the scheduled work—two parts per day, erect and then pour—; certainly has not slowed the work schedule; and has not required on site construction of components, nor even use of significantly different component parts.

Considerable detail has been set forth hereinabove with respect to: the method of prefabrication of components, the components themselves, the loadbearing wall panels, the floor/ceiling panels, the method of erection of rooms, the creation of the beam voids, the fabrication and use of loadbearing core modules, and the resulting monolithic, reinforced concrete framework. However, certain of the details can be modified by those skilled in the art, while remaining within the theme and scope of the invention herein. Moreover, the novel formation of the beam void can be incorporated advantageously into building construction of various types and lie within the spirit and scope of my invention as claimed.

What I claim is:

1. In a method for constructing a multi-level, multi-unit per level building with a monolithic framework including on-site poured concrete beams, the improvement comprising: defining at least one open area room, the open area of said open area room to be free of means for load supporting, such as walls and columns; erecting over that open area at least one prefabricated, trussed wall panel having the loadbearing capability of supporting the weight of all levels of said; positioning said trussed wall panel over a beam, and tying said beam to said trussed wall panel to provide upward support to said beam.

2. In a method for constructing a multi-level, multi-unit per level building with a framework including concrete beams, said beams spanning over unsupported areas of said building and supporting loads over such unsupported areas, the improvement comprising:

creating said beams, above a first level, without use of removable forms by the steps of:

erecting wall panels on a specific building level;

defining said wall panels by light weight framing including loadbearing studs of light gage steel, and at least one light weight metal, load bearing, column frame, said column frame capable of being filled with concrete;

each said wall panel having a top;

placing ceiling panels on top of said wall panels, said ceiling panels having vertical ends;

positioning said vertical ends of two of said ceiling panels so as to lie spaced apart on said top of one of said wall panels;

said vertical ends thereby defining the vertical, spaced apart sides of a volumetric beam void;

said top of said one wall panel defining the base of said volumetric beam void, and the top surface of said beam void retaining exposed; and filling said beam void with concrete to complete said area spanning, load supporting beam, which becomes part of a poured concrete, column supported framework.

3. In the method according to claim 2;

each said wall panel having a bottom;

securing to said bottom at least one guide member which projects downward from and along the length of said bottom; and creating a vertical groove along the top, exposed surface of said beam Soon after said beat void is filled with concrete;

the relative positions of said downward projecting guide member and said vertical groove being such that they will meet when a wall panel is positioned properly on top of said beam;

whereby, such wall panel will lie on top of said beam and be vertically aligned with said one wall panel.

4. In the method according to claim 2, said ceiling panels and wall panels being constructed and arranged relative to said beam forming void and said resulting beam so that said beam lies exterior of said ceiling panels and said wall panels.

5. In the method according to claim 2, causing the resulting loadbearing capability of said wall panels, by employing said light gage steel studs, to be at least sufficiently load supporting to support the weight of said ceiling panels and concrete beams positioned at said top of said wall panels, while the concrete of said beams above are hardening sufficiently to become load-bearing and then carry the loads down through the column frames.

6. In the method according to claim 2, securing anchor means to said vertical sides of said ceiling panels;

said anchor means projecting into said beam void such that, when the concrete in said beam void hardens, said ceiling panels are secured to said beam.

7. In the method according to claim 2, after erecting said wall panels and said ceiling panels for a specific building level and thereby creating said beam voids, pouring concrete into said beam voids.

8. In the method according to claim 7, constructing said column frame with an open top; whereby, pouring concrete into said beam voids enables the concrete to flow into column frames lying directly therebelow.

9. In the method according to claim 2, accomplishing during a first part of a construction day, for a specific level, said erecting of said wall panels and said placing and said positioning of said ceiling panels;

accomplishing during a second part of the same construction day, for said specific level, said filling with concrete said beam voids; and repeating said first part and said second part accomplishing on a next construction day for a one level higher level.

10. In the method according to claim 2, prefabricating said light weight wall panels and said ceiling panels into a self-contained core module.

11. In the method according to claim 2, mounting vertically a bearing, compression fitting into said beam void, said fitting having a top portion and a bottom portion;

said mounting being such that said bottom portion is in bearing surface contact with said top of said one wall panel, which defines said base of said beam void, and said top portion is in bearing surface contact with the bottom of another of said wall panels.

12. In the method according to claim 2, defining in said building at least one open area room, the open area of said open area room being free means for of load supporting, such as walls and columns; and erecting over that open area at least one prefabricated, trussed wall panel having the loadbearing capability of supporting the weight of all levels of said building positioned directly thereover.

13. In the method according to claim 12, positioning said trussed wall panel over one of said beams, and tying said beam to said trussed wall panel to provide upward support to said beam.

* * * * *

UNITED STATES PATENT AND TRADEMARK OFFICE

CERTIFICATE OF CORRECTION

PATENT NO : 5,867,964

DATED : February 9, 1999

INVENTOR(S) : Arthur Perrin

It is certified that error appears in the above-identified patent and that said Letters Patent are hereby corrected as shown below:

Claim 1, on column 22, line 40, delete "the weight of all levels of said;" and replace with --the weight of all levels of said building positioned directly thereover;--.

Signed and Sealed this

Tenth Day of April, 2001

*Attest:*

Nicholas P. Godici

NICHOLAS P. GODICI

*Attesting Officer*

*Acting Director of the United States Patent and Trademark Office*